United States Patent [19]

Edelman

[11] 4,394,467

[45] Jul. 19, 1983

[54] SIZED CARBON FIBERS CAPABLE OF USE WITH POLYIMIDE MATRIX

[75] Inventor: Robert Edelman, Staten Island, N.Y.

[73] Assignee: Celanese Corporation, New York, N.Y.

[21] Appl. No.: 276,108

[22] Filed: Jun. 22, 1981

[51] Int. Cl.[3] ..... B32B 5/00; B32B 27/06; D02G 3/00

[52] U.S. Cl. ..... 523/205; 428/367; 428/375; 428/378; 523/215; 524/600; 428/473.5

[58] Field of Search ..... 428/367, 375, 378, 474, 428/408; 528/229, 353; 523/205, 215; 524/600

[56] References Cited

U.S. PATENT DOCUMENTS

| | | | |
|---|---|---|---|
| 3,179,634 | 4/1965 | Edwards | 428/379 |
| 3,459,706 | 8/1969 | Schweitzer | 528/229 X |
| 3,597,301 | 8/1971 | Blanc et al. | 528/229 X |
| 3,770,539 | 11/1973 | Bullock | 428/367 X |
| 3,837,904 | 9/1974 | Hill | 428/367 X |
| 3,914,504 | 10/1975 | Weldy . | |
| 3,957,716 | 5/1976 | Weldy | 524/87 |
| 4,146,668 | 3/1979 | Dorey et al. | 428/367 X |

FOREIGN PATENT DOCUMENTS 89061 4/1972 German Democratic Rep. .

OTHER PUBLICATIONS

"Low Void Composites Based on NR-150 Polyimide Binders" by Gibbs; Hugh H., 28th Annual Technical Conference, 1973, Reinforced Plastics/Composites Institute, The Society of the Plastic Industry, Inc., Section 2D-pp. 1-3.

"The Development of Quality Control Techniques For NR-150 Polyimide Adhesive and Binder Materials" by Hugh H. Gibbs et al., pp. 11-17, Sample Journal, Jan., Feb., 1979.

Du Pont, NR-150 Polyimide Precursor Solutions, Bulletin No. 783, revised Mar. 1979, "4,4'-Oxydianiline (ODA)".

*Primary Examiner*—Lorraine T. Kendell

*Attorney, Agent, or Firm*—Herbert P. Price

[57] ABSTRACT

Carbon fibers are provided which bear an improved finish coating upon the surface which is capable of withstanding the high temperatures (e.g., above 500° F.) commonly encountered during the formation of composite structures employing a polyimide matrix. The sized carbon fibers prior to the curing to form a rigid polyimide coating are flexible, may be readily handled without significant damage, and are amenable to good impregnation with the matrix resin thereby facilitating the formation of quality composite structures. The finish comprises a mixture of selected precursors for the formation of a rigid polyimide (as described). More specifically, the size composition is formed from at least one aromatic diamine, at least one aromatic dianhydride, and at least one aromatic tetracarboxylic acid diester. A film-forming polyamic acid oligomer readily forms and is present as an intermediate reaction product within the finish coating and the aromatic tetracarboxylic acid diester has been found to beneficially serve primarily as a flexibility preserving diluent during the early stages of the polyimide-forming reaction which takes place within the finish coating. The finish is fully compatible with a polyimide matrix.

26 Claims, No Drawings

SIZED CARBON FIBERS CAPABLE OF USE WITH POLYIMIDE MATRIX

BACKGROUND OF THE INVENTION

In the search for high performance materials considerable interest has been focused upon carbon fibers. Industrial high performance materials of the future are projected to make substantial utilization of fiber reinforced composites, and carbon fibers theoretically have among the best properties of any fiber for use as high strength reinforcement. Among these desirable properties are corrosion and high temperature resistance, low density, high tensile strength, and high modulus.

Polymeric materials heretofore commonly have been selected as the matrix material in which the relatively delicate carbon fibers are incorporated to form high performance materials with the carbon fibers serving as a light weight fibrous reinforcement. Epoxy resins most frequently have been selected as the matrix material. Additionally, the use of polyimides as the matrix material has been proposed primarily because of the ability of the polyimides to withstand even higher temperatures during use.

In order to improve the handleability of the carbon fibers without undue fiber damage during the formation of composite articles it has been the common practice to apply a flexible size or finish to the surface of the same. See, for instance, the epoxy size disclosed in U.S. Pat. Nos. 3,914,504 and 3,957,716. The sized carbon fibers bearing the epoxy coating are commonly incorporated in an epoxy matrix resin and a rigid composite article is formed upon curing. Epoxy matrix resins are commonly cured at temperatures below approximately 450° F. If higher temperatures are encountered, the physical properties of the resulting composite article tend to be reduced.

There has remained a need for a highly satisfactory size or finish for use with carbon fibers which is capable of withstanding, without decomposition or loss of the desired size qualities, the more severe temperature conditions encountered when a polyimide serves as the matrix resin. For instance, polyimide resins commonly require an extended curing temperature at 550° to 600° F. At such temperatures epoxy sizes can be expected to undergo some level of degradation which can undesirably influence the physical properties of the resulting composite article.

Polyimide sizes also have been proposed in the prior art, but while being capable of withstanding the temperature involved during the curing of a polyimide matrix resin, have nevertheless been deficient in providing the desired improvement in handleability. Accordingly, the handleability of carbon fibers bearing these sizes generally has been very poor. For instance, if one selects as a size composition a common polyimide precursor solution containing at least one aromatic diamine, and at least one aromatic tetracarboxylic acid, and/or at least one aromatic diacid diester, the various components tend to lack the requisite film-forming characteristics to yield a satisfactory size. For instance, the monomers present tend to be dissolved solids and a brittle non-flexible and non-uniform coating tends to be deposited upon the surface of the carbon fibers which lacks those qualities commonly sought in size. This type of size results in extremely high levels of fuzz because of inadequate fiber protection and renders the weaving of the same virtually impossible.

It is an object of the present invention to provide sized carbon fibers which may be readily handled without undue fuzz formation or damage to the same.

It is an object of the present invention to provide improved sized carbon fibers which are capable of withstanding high temperatures (e.g., above 500° F.) without deleterious results.

It is an object of the present invention to provide improved sized carbon fibers which are particularly suited for use in the formation of composite structures wherein a polyimide serves as the matrix material.

It is an object of the present invention to provide improved sized carbon fibers which produce minimal fuzz upon handling.

It is an object of the present invention to provide improved sized carbon fibers which are flexible and capable of readily undergoing impregnation with a matrix material.

It is a further object of the present invention to provide an improved carbon fiber reinforced composite structure comprising a polyimide matrix and a polyimide size coating on the carbon fibers which does not result in any substantial diminution in the overall physical properties of the composite structure.

These and other objects, as well as the scope, nature, and utilization of the claimed invention will be apparent to those skilled in the art from the following detailed description and appended claims.

SUMMARY OF THE INVENTION

A carbon fiber is provided having a flexible coating on the surface thereof in a concentration of approximately 0.3 to 5.0 percent by weight based upon the weight of the carbon fiber of a sizing composition which comprises a polyamic acid oligomer, and is capable of yielding a rigid polyimide at elevated temperatures which is derived from the reaction of at least one aromatic diamine, at least one aromatic dianhydride, and at least one aromatic tetracarboxylic acid diester in which the carboxylic acid groups and ester groups are ortho disposed, wherein the polyamic acid oligomer is an intermediate in the formation of said rigid polyimide.

A composite structure is provided comprising a rigid polyimide matrix having carbon fibers incorporated therein which are coated on the surface thereof with approximately 0.3 to 5.0 percent by weight based upon the weight of the carbon fibers of a sizing composition comprising a rigid polyimide coating which is derived from the reaction of at least one aromatic diamine, at least one aromatic dianhydride, and at least one aromatic tetracarboxylic acid diester in which the carboxylic acid groups and ester groups are ortho disposed, wherein a polyamic acid oligomer is formed as an intermediate during the formation of the rigid polyimide coating and is present within a flexible coating comprising the reactants which facilitates impregnation of the coated carbon fibers with the matrix during the formation of the composite structure.

DESCRIPTION OF PREFERRED EMBODIMENTS

The carbon fibers which are provided with a protective size coating in accordance with the present invention contain at least 90 percent carbon by weight (e.g., at least 95 percent carbon by weight in preferred embodiments) and such carbon may be either amorphous or graphitic in nature. Suitable carbon fibers are commercially available and commonly are of a relatively low denier per filament of approximately 0.5 to 2 thereby rendering them susceptible to damage during handling in the absence of a satisfactory size coating, particularly if the fibers also possess a relatively high Young's modulus. Representative carbon fibers are disclosed in commonly assigned U.S. Pat. Nos. 3,775,520; 3,900,556, 3,925,524; and 3,954,950.

The carbon fibers prior to sizing may optionally have their surface characteristics modified so as to improve their ability to bond to a resinous matrix material. Representative surface modification processes are disclosed in U.S. Pat. Nos. 3,657,082; 3,671,411; 3,723,150; 3,723,607; 3,754,957; 3,759,805; 3,859,187; 3,894,884; and in commonly assigned U.S. Ser. No. 222,970, filed Jan. 5, 1981.

The carbon fibers prior to sizing are preferably provided as a multifilamentary fibrous material such as a continuous length of a multifilamentary yarn, tow, strand, tape, etc. However, staple carbon fibers or other fibrous assemblages may be satisfactorily sized through the use of the present invention. For best results the configuration of the carbon fibers is such that the surfaces of the individual fibers are substantially exposed when the size composition is applied.

The size composition which forms a flexible size on the surface of the carbon fibers comprises a film-forming polyamic acid oligomer and is capable of yielding a rigid polyimide at elevated temperatures which is derived from the reaction of (1) at least one aromatic diamine, (2) at least one aromatic dianhydride, (3) and at least one aromatic tetracarboxylic acid diester in which the carboxylic acid groups and ester groups are ortho disposed, wherein the polyamic acid oligomer is an intermediate in the formation of the rigid polyimide. The polyamic acid oligomer alternatively can be termed a polyamide acid oligomer.

Representative aromatic diamines are p-phenylenediamine, m-phenylenediamine, 4,4'-oxydianiline, 4,4'-methylenedianiline, 4,4'-diaminodiphenylsulfone, 4,4'-diaminobenzophenone, 4,4'-diaminobiphenyl, 3,3'-diaminodiphenylsulfone, 3,3'-diaminobenzophenone, and mixtures thereof. Particularly satisfactory results have been obtained when a mixture of approximately 95 percent by weight of p-phenylenediamine and approximately 5 percent by weight of m-phenylenediamine is selected. The aromatic diamine reactant preferably is provided in a concentration of approximately 50 mole percent based upon the total concentration of the three classes of reactants.

Representative aromatic dianhydrides are 3,3',4,4'-benzophenonetetracarboxylic dianhydride, pyromellitic dianhydride, 3,3',4,4'-(hexafluoroisopropylidene)-bis(phthalic anhydride), and mixture thereof. Particularly satisfactory results have been obtained when 3,3',4,4'-benzophenonetetracarboxylic dianhydride is selected. The aromatic dianhydride reactant preferably is provided in a concentration of approximately 30 to 40 mole percent based upon the total concentration of the three classes of reactants, and most preferably in a concentration of approximately 35 mole percent based upon the total concentration of the three classes of reactants. The aromatic dianhydride is capable of undergoing an immediate reaction with the aromatic diamine even at ambient conditions to yield a polyamic acid oligomer. Other polyimide-forming reactants such as aromatic tetracarboxylic acids and aromatic diester diacids have been found to be substantially incapable of undergoing such reaction with the aromatic diamine to form the desired film-forming polyamic acid oligomer. The formation of the film-forming polyamic acid oligomer continues during the application of the size while the size composition is heated while present on the carbon fibers at moderate temperatures, e.g., at approximately 150° C. for approximately 2 minutes as described hereafter.

The aromatic tetracarboxylic acid diester may be formed by known techniques through the reaction of an aromatic dianhydride with an alcohol having 1 to 6 carbon atoms. Representative alcohols for this reaction are methyl alcohol, ethyl alcohol, n-propyl alcohol, isopropyl alcohol, isobutyl alcohol, tert-butyl alcohol, n-amyl alcohol, hexyl alcohol, etc. The preferred alcohol for use when forming the aromatic tetracarboxylic acid diester is ethyl alcohol.

Representative aromatic tetracarboxylic acid diesters are 3,3'-diethylester of 3,3',4,4'-benzophenonetetracarboxylic acid, 3,3'-diethylester of 3,3',4,4'-(hexafluoroisopropylidene)bis(phthalic acid), 1,5-diethylester of pyromellitic acid, and mixtures thereof. Particularly satisfactory results have been obtained when the 3,3'-diethylester of 3,3',4,4'-benzophenonetetracarboxylic acid is selected. The aromatic tetracarboxylic acid diester preferably is provided in a concentration of approximately 10 to 20 mole percent based upon the total concentration of the three classes of reactants, and most preferably in a concentration of approximately 15 mole percent based upon the total concentration of the three classes of reactants. In the present invention the aromatic tetracarboxylic acid diester undergoes only minimal reaction with the aromatic diamine while the coating on the carbon fibers is serving its function as a flexible size. It is only upon heating at more elevated temperatures that the aromatic tetracarboxylic acid diester enters into the polyimide-forming reaction. While present in the size the aromatic tetracarboxylic acid diester beneficially contributes to the desirable properties exhibited by maintaining size flexibility. It serves the key role in the present invention of controlling the development of the desired polyamic acid oligomer. Since this material serves as a reactive diluent, it does not diminish the ultimate cured properties of a polyimide composite because it will react with the other components to form a polyimide during the composite cure cycle. If the aromatic tetracarboxylic acid diester is omitted from the size composition and molar concentration of the aromatic dianhydride correspondingly is increased, then it has been found that the reaction between these two polyamic acid-forming reactants is too extreme and tends to greatly diminish the desired flexibility of the size composition when present upon the carbon fibers at moderate temperatures. The resulting stiffness of the carbon fiber bundles then prevents adequate wetting of the fibers during resin impregnation.

The flexible size coating preferably is applied to the carbon fibers when dissolved in a polar solvent which is incapable of harming the carbon fibers. Representative solvents for the reactants and resulting polyamic acid are N-methyl pyrrolidone, dimethylformamide, dimethylacetamide, dimethylsulfoxide, etc. Such solvents tend to be relatively high boiling (e.g., have a boiling point above approximately 150° C.). In a preferred embodiment a relatively volatile solvent (e.g., having a boiling point below approximately 70° C.) additionally is also present and is believed to aid in the removal of the polar solvent following contact of the carbon fibers with the dissolved reactants which are capable of forming the desired size. The preferred polar solvent for the reactants is N-methyl pyrrolidone and the preferred volatile solvent is acetone. Particularly satisfactory results are achieved when approximately 30 percent by weight of the solvent mixture is N-methyl pyrrolidone and approximately 70 percent by weight of the solvent mixture is acetone. The total concentration of the reactants present in the solvent mixture when initially contacted with the carbon fibers preferably is approximately 0.6 to 10 percent by weight based upon the total weight of the solution.

The solution which is capable of forming the flexible size coating may be applied to the carbon fibers by any suitable technique such as dipping, padding, etc. The solution preferably is provided at a temperature of approximately room temperature (e.g. approximately 25° C.) when applied to the carbon fibers. Once the solution is applied, the solvent is substantially volatilized by heating in an appropriate zone which is provided at a more highly elevated temperature. The temperature of such zone will be influenced by the boiling point of the polar solvent selected and preferably does not exceed approximately to 150° to 160° C. Heating times of approximately 2 minutes have been found to be satisfactory. Appropriate equipment and safety precautions must be taken to insure the safety of personnel in the area and to effectively deal with the explosion hazard created by solvent vapors. Every effort is made to remove the solvent to the fullest extent possible; however, a minor amount of N-methyl pyrrolidone will still be present in the size composition following such heating.

Upon volatilization of the solvent the size coating is deposited upon the surface of the carbon fiber in a concentration of approximately 0.3 to 5.0 percent by weight based upon the weight of the carbon fiber, and most preferably in a concentration of 0.5 to 1.3 percent by weight based upon the weight of the carbon fiber.

In a preferred embodiment the flexible coating on the surface of the carbon fiber comprises a polyamic acid oligomer, and is capable of yielding a rigid polyimide at more highly elevated temperatures which is derived from the reaction of approximately 47.5 mole percent of p-phenylenediamine, approximately 2.5 mole percent of m-phenylenediamine, approximately 35 mole percent of 3,3',4,4'-benzophenonetetracarboxylic dianhydride, and approximately 15 mole percent of 3,3'-diethylester of 3,3',4,4-benzophenonetetracarboxylic acid. The polyamic acid oligomer in this instance is formed primarily upon the reaction of the p-phenylenediamine, the m-phenylenediamine, and the benzophenonetetracarboxylic dianhydride to form an oligomer of the following general formula wherein the corresponding moieties derived from m-phenylenediamine are not shown for simplicity of illustration:

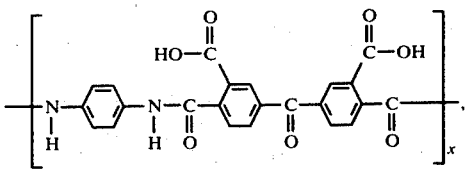

where x is a small number, e.g., approximately 2 to 10, or more.

The carbon fiber bearing the flexible size coating in accordance with the present invention may be handled without undue damage. The fuzz problem which commonly exists when one attempts to process continuous lengths of unsized carbon fibers is significantly reduced. Also bundles of carbon fibers bearing the size coating are amenable to flattening and spreading thereby facilitating ready impregnation of the same by the matrix resin during the formation of a composite structure in accordance with standard technology. Such impregnation is believed to result in composite structures possessing improved mechanical properties. Additionally the size coating is highly compatible with a polyimide matrix resin and is capable of withstanding the elevated temperatures for the curing of a polyimide matrix resin (e.g., 500° to 700° F.). Carbon fiber bundles bearing the size of the present invention can be woven without any substantial damage to the relatively delicate carbon fibers.

At the higher temperatures encountered during the formation of a composite article the flexible size coating is transformed into a solid polyimide through the reaction of all of the reactants. Representative polyimide resins which may be employed as the matrix resin during the formation of a composite structure are bismaleimide resins, which are manufactured by Rhone Poulenc under the designation Kerimid 601, 353, and MVR711, and by Technochemie GmbH under the designation M751, M756, and H795; addition condensation polyimides which are manufactured by Hexcel and Kingmar Labs under the designation LaRC 160, and by U.S. Polymeric under the designation PMR 15; and condensation polyimides by E. I. DuPont de Nemours & Co. under the designation NR-150, NR-150A, NR-150A2, NR-150A2G, NR-150A2S5X, NR-150B, NR-056X, NR-058X, etc. The NR-150 polyimide is discussed in "Low Void Composites Based on NR-150 Polyimide Binders" by Hugh H. Gibbs, published at Section 2-D, Page 1 to 3 of the 28th Annual Technical Conference, 1973, Reinforced Plastics Composites Institute, The Society of the Plastics Industry, Inc.; and in "The Development of Quality Control Techniques for NR-150 Polyimide Adhesive and Binder Materials" by Hugh H. Gibbs and John R. Ness, published at Pages 11 to 17 SAMPE Journal, January February 1979. The NR-058X polyimide has been marketed as a polyimide precursor solution containing a polyamide acid based on 4,4'-oxydianiline.

The sized carbon fibers may be impregnated with the composition which forms the matrix resin (1) by contact with a resin film followed by heat and pressure, (2) by pulling through a bath containing molten matrix-forming components, or (3) by coating with a resin solution containing a low boiling solvent which is subsequently removed by running the coated fibers through a heated oven.

The sized carbon fibers following curing preferably are provided in the polyimide matrix resin in a concentration of approximately 50 to 73 percent by volume and most preferably in a concentration of approximately 60 to 65 percent by volume based upon the total volume of the final composite structure.

The resulting composite articles can be utilized as strong lightweight structural components which are capable of service at elevated temperature (e.g., 500° to 600° F.). For instance, the composite articles may serve in aerospace components, particularly for engine applications, such as engine cowls, engine nacelle, engine oil tank ducts as well as shuttle orbiter aft body flaps, etc.

The following example is presented as a specific illustration of the claimed invention. It should be understood, however, that the invention is not limited to the specific details set forth in the example.

EXAMPLE

The carbon fiber selected for sizing was a yarn of carbonaceous filamentary material derived from an acrylonitrile copolymer consisting of approximately 98 mole percent of acrylonitrile units and 2 mole percent methylacrylate units. The carbonaceous material consisted of approximately 6000 substantially parallel filaments, contained approximately 93 percent carbon by weight, and was commercially available from the Celanese Corporation under the designation of Celion 6000. Representative average filament properties for the carbon fiber were a denier of 0.6, a tensile strength of approximately 470,000 psi, a Young's modulus of approximately 34 million psi, and an elongation of approximately 1.4 percent.

To vessel No. 1 were added, at room temperature with stirring, 173.4 parts by weight of N-methyl pyrrolidone, 11.3 parts by weight of p-phenylenediamine, and 0.6 parts by weight of m-phenylenediamine. The p-phenylenediamine and the m-phenylenediamine dissolved in the N-methyl pyrrolidone solvent. While stirring continued, 27.3 parts by weight of 3,3',4,4'-benzophenonetetracarboxylic dianhydride were slowly added and the temperature was allowed to rise to a maximum of approximately 40° C. Stirring continued until the benzophenonetetracarboxylic dianhydride as well as all other components were completely dissolved.

To vessel No. 2 were added, at room temperature with stirring, 25 parts by weight of N-methyl pyrrolidone and 8.31 parts by weight of 3,3',4,4'-benzophenonetetracarboxylic dianhydride. The temperature was raised to 70° C. and stirring continued. When all of the 3,3',4,4'-benzophenonetetracarboxylic dianhydride had dissolved, 2.4 parts by weight of absolute ethyl alcohol were added to the heated solution. A cover was placed over vessel No. 2 to prevent evaporation of the ethyl alcohol, and the temperature was raised to 80° C. and held at that temperature for 30 minutes. This solution which contained the dissolved 3,3'-diethylester of 3,3',4,4'-benzophenonetetracarboxylic acid as a reaction product was cooled to room temperature.

The solution from vessel No. 2 was added to vessel No. 1 with stirring while the contents of vessel No. 1 were at room temperature. The resulting concentrated mixture contained 20.1 percent by weight solids dissolved therein, and was stored under refrigeration until diluted for application as a size or finish to the carbon fibers.

A portion of the concentrated mixture next was diluted with additional N-methyl pyrrolidone and with acetone to form the size solution which was applied to the carbon fibers. The resulting solvent mixture was composed of 70 percent by weight acetone, and 30 percent by weight N-methyl pyrrolidone and the size components were present therein in a concentration of 0.9 percent by weight based upon the total weight of the solution. More specifically, 100 parts by weight of the concentrated mixture were first mixed with 548 parts by weight of N-methyl pyrrolidone and then 1549 parts by weight of acetone were next dropwise added while stirring to form the final sizing solution.

The resulting dilute size solution was applied to the carbon fiber within one day of its formation. The solution contained a film-forming polyamic acid oligomer which was formed primarily by the reaction of the p-phenylenediamine and the m-phenylenediamine with the 3,3',4,4'-benzophenonetetracarboxylic dianhydride. The 3,3'-diethylester of 3,3',4,4'-benzophenonedicarboxylic acid present served primarily as an unreacted diluent which was capable of entering into the polyimide-forming reaction at more highly elevated temperatures. The presence of such reactive diluent served to limit the increase in viscosity resulting from the polyamic acid oligomer formation thereby preserving the desired flexibility of the size coating.

More specifically, the sizing of the continuous length of the carbon fibers was accomplished while being dipped within and being passed in the direction of its length at a rate of 5 meters per minute through a metal trough containing the sizing solution at room temperature.

The solvent next was removed from the surface of the carbon fibers by drying for a residence time of two minutes in a circulating air oven provided at 150° C. A flexible coating was provided on the surface of the carbon fiber in a concentration of 0.6 percent by weight, which imparted highly improved handling characteristics to the carbon fibers while significantly reducing the fuzz level. A very small amount of N-methyl pyrrolidone was present within this resulting size coating but did not significantly reduce the properties of the composite article ultimately produced.

The sized carbon fiber was capable of spreading to well accommodate impregnation with a standard polyimide matrix resin system during the formation of a carbon fiber reinforced composite structure. Upon curing the size coating also yields a rigid polyimide which is highly compatible with the polyimide matrix.

Although the invention has been described with a preferred embodiment, it is to be understood that variations and modifications may be employed without departing from the concept of the invention as defined in the following claims.

I claim:

1. A carbon fiber having a flexible coating on the surface thereof in a concentration of approximately 0.3 to 5.0 percent by weight based upon the weight of the carbon fiber of a sizing composition which comprises a polyamic acid oligomer, and is capable of yielding a rigid polyimide at elevated temperatures which is derived from the reaction of at least one aromatic diamine, at least one aromatic dianhydride, and at least one aromatic tetracarboxylic acid diester in which the carboxylic acid groups and ester groups are ortho disposed, wherein said polyamic acid oligomer is an intermediate in the formation of said rigid polyimide.

2. A carbon fiber having a flexible coating on the surface thereof according to claim 1 wherein said coating is present in a concentration of approximately 0.5 to 1.3 percent by weight based upon the weight of the carbon fiber.

3. A carbon fiber having a flexible coating on the surface thereof according to claim 1 which is capable of forming said rigid polyimide through the reaction of approximately 50 mole percent of said at least one aromatic diamine, approximately 30 to 40 mole percent of said at least one aromatic dianhydride, and approximately 10 to 20 mole percent of said at least one aromatic tetracarboxylic acid diester wherein the carboxylic acid groups and ester groups are ortho disposed.

4. A carbon fiber having a flexible coating on the surface thereof according to claim 1 wherein acid aromatic diamine is selected from the group consisting of p-phenylenediamine, m-phenylenediamine, 4,4'-oxydianiline, 4,4'-methylenedianiline, 4,4'-diaminodiphenylsulfone, 4,4'-diaminobenzophenone, 4,4'-diaminobiphenyl, 3,3'-diaminodiphenylsulfone, 3,3'-diaminobenzophenone, and mixtures of the foregoing.

5. A carbon fiber having a flexible coating on the surface thereof according to claim 1 wherein said aromatic diamine is a mixture of approximately 95 percent by weight p-phenylenediamine and approximately 5 percent by weight of m-phenylenediamine.

6. A carbon fiber having a flexible coating on the surface thereof according to claim 1 wherein said aromatic dianhydride is 3,3',4,4'-benzophenonetetracarboxylic dianhydride, pyromellitic dianhydride, 3,3',4,4'-(hexafluoroisopropylidene)bis(phthalic anhydride), and mixtures of the foregoing.

7. A carbon fiber having a flexible coating on the surface thereof according to claim 1 wherein said aromatic dianhydride is 3,3',4,4'-benzophenonetetracarboxylic dianhydride.

8. A carbon fiber having a coating on the surface thereof according to claim 1 wherein said aromatic tetracarboxylic acid diester is formed by the reaction of an aromatic dianhydride and an alcohol having one to six carbon atoms.

9. A carbon fiber having a flexible coating on the surface thereof according to claim 8 wherein said alcohol is ethanol.

10. A carbon fiber having a coating on the surface thereof according to claim 1 wherein said aromatic tetracarboxylic acid diester is the 3,3'-diethylester of 3,3',4,4'-benzophenonetetracarboxylic acid, the 3,3'-diethylester of 3,3'4,4'-(hexafluoroisopropylidene)-bis(phthalic acid), the 1,5-diethylester of pyromelletic acid, and mixtures of the foregoing.

11. A carbon fiber having a coating on the surface thereof according to claim 1 wherein said aromatic tetracarboxylic acid diester is the 3,3'-diethylester of 3,3',4,4'-benzophenonetetracarboxylic acid.

12. A carbon fiber having a flexible coating on the surface thereof in a concentration of approximately 0.3 to 5.0 percent by weight based upon the weight of the carbon fiber of a sizing composition which comprises a polyamic acid oligomer, and is capable of yielding a rigid polyimide at elevated temperatures which is derived from the reaction of approximately 47.5 mole percent of p-phenylenediamine, approximately 2.5 mole percent of m-phenylenediamine, approximately 35 mole percent of 3,3',4,4'-benzophenonetetracarboxylic dianhydride, and approximately 15 mole percent of the 3,3'-diethylester of 3,3',4,4'-benzophenonetetracarboxylic acid wherein said polyamic acid oligomer is an intermediate in the formation of said rigid polyimide.

13. A carbon fiber having a flexible coating on the surface thereof in a concentration of approximately 0.5 to 1.3 percent by weight based upon the weight of the carbon fiber.

14. A composite structure comprising a rigid polyimide matrix having carbon fibers incorporated therein which are coated on the surface thereof with approximately 0.3 to 5.0 percent by weight based upon the weight of the carbon fibers of a sizing composition comprising a rigid polyimide coating which is derived from the reaction of at least one aromatic diamine, at least one aromatic dianhydride, and at least one aromatic tetracarboxylic acid diester in which the carboxylic acid groups and ester groups are ortho disposed, wherein a polyamic acid oligomer is formed as an intermediate during the formation of said rigid polyimide coating and is present within a flexible coating comprising said reactants which facilitates impregnation of said coated carbon fibers with said matrix during the formation of said composite structure.

15. A composite structure according to claim 14 wherein said rigid polyimide coating is present in a concentration of approximately 0.5 to 1.3 percent by weight based upon the weight of the carbon fibers.

16. A composite structure according to claim 14 wherein said rigid polyimide coating is derived from the reaction of approximately 50 mole percent of said at least one aromatic diamine, approximately 30 to 40 mole percent of said at least one aromatic dianhydride, and approximately 10 to 20 mole percent of said at least one aromatic tetracarboxylic acid diester wherein the carboxylic acid groups and ester groups are ortho disposed.

17. A composite structure according to claim 14 wherein said aromatic diamine is selected from the group consisting of p-phenylenediamine, m-phenylenediamine, 4,4'-oxydianiline, 4-4'-methylenedianiline, 4,4'-diaminodiphenylsulfone, 4,4'-diaminobenzophenone, 4,4'-diaminobiphenyl, 3,3'-diaminodiphenylsulfone, 3,3'-diaminobenzophenone, and mixtures of the foregoing.

18. A composite structure according to claim 14 wherein said aromatic diamine is a mixture of approximately 95 percent by weight p-phenylenediamine and approximately 5 percent by weight of m-phenylenediamine.

19. A composite structure according to claim 14 wherein said aromatic dianhydride is 3,3',4,4'-benzophenonetetracarboxylic dianhydride, pyromellitic dianhydride, 3,3',4,4'-(hexafluoroisopropylidene)bis(phthalic anhydride), and mixtures of the foregoing.

20. A composite structure according to claim 14 wherein said aromatic dianhydride is 3,3'4,4'-benzophenonetetracarboxylic dianhydride.

21. A composite structure according to claim 14 wherein said aromatic tetracarboxylic acid diester is formed by the reaction of an aromatic dianhydride and an alcohol having one to six carbon atoms.

22. A composite structure according to claim 21 wherein said alcohol is ethanol.

23. A composite structure according to claim 14 wherein said aromatic tetracarboxylic acid diester is the 3,3'-diethylester of 3,3',4,4'-benzophenonetetracarboxylic acid, the 3,3'-diethylester of 3,3',4,4'-(hexafluoroisopropylidene)bis(phthalic acid), the 1,5-diethylester of pyromellitic acid, and mixtures of the foregoing.

24. A composite structure according to claim 14 wherein said aromatic tetracarboxylic acid diester is the 3,3'-diethylester of 3,3',4,4'-benzophenonetetracarboxylic acid.

25. A composite structure comprising a rigid polyimide matrix having carbon fibers incorporated therein which are coated on the surface thereof with approximately 0.3 to 5.0 percent by weight based upon the weight of the carbon fibers of a sizing composition comprising a rigid polyimide coating which is derived from the reaction of approximately 47.5 mole percent of p-phenylenediamine, approximately 2.5 mole percent of m-phenylenediamine, approximately 35 mole percent of 3,3',4,4'-benzophenonetetracarboxylic dianhydride, and approximately 15 mole percent of the 3,3'-diethylester of 3,3',4,4'-benzophenonetetracarboxylic acid, wherein a polyamic acid oligomer is formed as an intermediate during the formation of said rigid polyimide coating and is present within a flexible coating comprising said reactants which facilitates impregnation of said coated carbon fibers with said matrix during the formation of said composite structure.

26. A composite structure according to claim 25 wherein said carbon fibers are coated on the surface thereof with approximately 0.5 to 1.3 percent weight based upon the weight of the carbon fibers of said sizing composition comprising a rigid polyimide.

* * * * *